US009060408B2

(12) United States Patent
Shi et al.

(10) Patent No.: US 9,060,408 B2
(45) Date of Patent: Jun. 16, 2015

(54) THERMAL DE-RATING POWER SUPPLY FOR LED LOADS

(71) Applicant: iWatt Inc., Campbell, CA (US)

(72) Inventors: Fuqiang Shi, Oak Park, IL (US); Qiu Sha, Cupertino, CA (US); Xiaolin Gao, Santa Clara, CA (US); Gordon Chen, Fremont, CA (US)

(73) Assignee: Dialog Semiconductor Inc., Campbell, CA (US)

( * ) Notice: Subject to any disclaimer, the term of this patent is extended or adjusted under 35 U.S.C. 154(b) by 30 days.

(21) Appl. No.: 13/801,409

(22) Filed: Mar. 13, 2013

(65) Prior Publication Data

US 2014/0015447 A1 Jan. 16, 2014

Related U.S. Application Data

(60) Provisional application No. 61/670,077, filed on Jul. 10, 2012.

(51) Int. Cl.
*H05B 37/02* (2006.01)
*H05B 33/08* (2006.01)

(52) U.S. Cl.
CPC ..... *H05B 33/0854* (2013.01); *H05B 33/089* (2013.01)

(58) Field of Classification Search
CPC ..... H05B 33/0854; H05B 33/089
USPC ..... 315/309, 291, 307, 158, 224, 35, 159, 315/169.3, 185 R, 246, 247, 312, 77; 362/249.02, 373; 257/467, 570; 340/636.13, 636.15; 361/103; 345/102; 363/50
See application file for complete search history.

(56) References Cited

U.S. PATENT DOCUMENTS

| | | | | |
|---|---|---|---|---|
| 7,262,752 | B2 * | 8/2007 | Weindorf | 345/82 |
| 7,884,557 | B2 | 2/2011 | Steele et al. | |
| 7,978,487 | B2 * | 7/2011 | Lin | 363/55 |
| 8,125,199 | B2 * | 2/2012 | Tsai | 323/222 |
| 2008/0079371 | A1 | 4/2008 | Kang et al. | |

(Continued)

FOREIGN PATENT DOCUMENTS

| | | | |
|---|---|---|---|
| CN | 101155450 | A | 4/2008 |
| DE | 102 01 053 | A1 | 8/2002 |
| DE | 10 2010 002 227 | A1 | 8/2011 |

(Continued)

OTHER PUBLICATIONS

European Patent Office, European Search Report and Opinion, European Patent Application No. 13175761.9, Oct. 24, 2013, seven pages.

(Continued)

*Primary Examiner* — Douglas W Owens
*Assistant Examiner* — Borna Alaeddini
(74) *Attorney, Agent, or Firm* — Fenwick & West LLP

(57) ABSTRACT

Embodiments disclosed herein describe the use of a power supply to provide power to an LED load. The power supply provides a present output current to the LED, and receives a temperature signal representing the operating temperature of the LED. A target output current is determined, for instance based on the temperature signal. An output current rate of change is determined, and the power supply adjusts the output current to the LED at the determined rate of change until the output current is substantially equal to the target current.

21 Claims, 7 Drawing Sheets

(56) References Cited

U.S. PATENT DOCUMENTS

| | | | | |
|---|---|---|---|---|
| 2012/0229047 | A1 | 9/2012 | Chiu et al. | |
| 2013/0033198 | A1 * | 2/2013 | Kang et al. | 315/309 |

FOREIGN PATENT DOCUMENTS

| | | | |
|---|---|---|---|
| DE | 102010002227 | A1 * | 8/2011 |
| EP | 1 349 433 | A2 | 10/2003 |
| EP | 1 659 831 | A1 | 5/2006 |
| JP | 2012-61936 | A | 3/2012 |
| TW | 1308468 | B | 4/2009 |

OTHER PUBLICATIONS

Taiwan Intellectual Property Office, Office Action, Taiwan Patent Application No. 102121810, Mar. 24, 2015, sixteen pages.

* cited by examiner

THERMAL DE-RATING POWER SUPPLY FOR LED LOADS

RELATED APPLICATIONS

This application claims the benefit of U.S. Provisional Application No. 61/670,077, filed Jul. 10, 2012, the content of which is incorporated by reference herein in its entirety.

BACKGROUND

1. Field of Technology

Embodiments disclosed herein relate generally to a power supply, and more specifically, to a power supply configured to provide a thermally de-rated output to a light-emitting diode ("LED")-based load.

2. Description of the Related Arts

Traditional incandescent lighting is gradually being replaced by power-saving LED-based lighting solutions in many homes, businesses, and other societal institutions. In order to maintain a stable level of light-emission by an LED, a power supply provides a stable current to the LED. An LED can be thermally rated to identify a maximum temperature threshold for safe operation of the LED (a "safety threshold" herein). In other words, operating the LED above the safety threshold temperature may lead to damage to the LED. An LED's temperature is generally proportional to the current flowing through the LED. Accordingly, to reduce the temperature of an LED being operated above the safety threshold, the current through the LED can be reduced.

When prompted, conventional power supplies provide increased and decreased current to loads substantially immediately. Providing such increases and decreases of current to an LED can cause immediate increases and decreases in light emission, visible light flickering, or other lighting artifacts, resulting in an unpleasant user experience. Accordingly, there is a need to provide and control the supply of current to an LED load such that the temperature in an LED operated above the temperature threshold can be reduced while minimizing undesirable lighting artifacts.

SUMMARY

Embodiments disclosed herein describe a power supply configured to provide power to an LED load. The power supply can adjust a provided output current to the LED in such a way as to minimize lighting artifacts, such as flickering or immediate/visible changes in light emission. In some embodiments, the power supply can linearly or gradually change the output current, reducing noticeable changes in light emission to the extent possible.

The power supply can be configured to detect LED over-temperature conditions and to adjust output current to the LED in response. In one embodiment, the power supply receives a temperature signal representative of the LED's operating temperature. In response, the power supply can identify a target output current to provide to the LED in order to alleviate the over-temperature condition. In addition, the power supply can determine an output current rate of change, and can adjust the output current at the determined rate of change until the output current is substantially equal to the target current.

The determined output current rate of change can be selected such that the output current is reduced quickly enough to reduce the operating temperature of the LED to avoid damaging the LED. Similarly, the determined output current rate of change can be selected such that the output current is adjusted slowly enough to reduce immediate or noticeable changes in light emission. Different rates of change can be selected when increasing output current than when decreasing output current. Rates of changes can be pre-programmed into the power supply, or can be input by a user of the power supply.

The features and advantages described in the specification are not all inclusive and, in particular, many additional features and advantages will be apparent to one of ordinary skill in the art in view of the drawings and specification. Moreover, it should be noted that the language used in the specification has been principally selected for readability and instructional purposes, and may not have been selected to delineate or circumscribe the inventive subject matter.

BRIEF DESCRIPTION OF THE DRAWINGS

The teachings of the embodiments of the present invention can be readily understood by considering the following detailed description in conjunction with the accompanying drawings.

DETAILED DESCRIPTION OF EMBODIMENTS

The Figures (Figs.) and the following description relate to various embodiments by way of illustration only. It should be noted that from the following discussion, alternative embodiments of the structures and methods disclosed herein will be readily recognized as viable alternatives that may be employed without departing from the principles discussed herein.

Reference will now be made in detail to several embodiments, examples of which are illustrated in the accompanying figures. It is noted that wherever practicable similar or like reference numbers may be used in the figures and may indicate similar or like functionality. The figures depict various embodiments for purposes of illustration only. One skilled in the art will readily recognize from the following description that alternative embodiments of the structures and methods illustrated herein may be employed without departing from the principles described herein.

Pulse width modulation and pulse frequency modulation are used within power supplies to regulate power outputs. Such regulation includes constant voltage and constant current output regulation. A power supply can include a power stage for delivering electrical power from a power source to a load; the power stage can include a switch and a switch controller for controlling the on-time and off-time of the switch. The on-time and off-time of the switch can be driven by this controller based upon a feedback signal representing the output power, output voltage, or output current.

In addition to regulating a power output, a switching power supply can protect against various fault conditions. One such fault condition is the operation of an LED load over a safe threshold temperature (an "over-temperature" condition). Other fault conditions include short-circuits, over-voltages, and over-currents. When a fault condition is detected, the power supply can disable or adjust the output of the power supply until the fault condition is rectified. In embodiments in which LED over-temperature fault conditions are detected, the power supply can switch operating modes to adjust the current provided to an LED load.

It should be noted that although the embodiments of the power supply described herein are limited to providing power to LED loads, in other embodiments, the power supplies can be coupled to other types of loads, such as speakers, microphones, and the like. It should also be noted that although various components and signals are described herein as analog or digital, the principles and functions described herein are not limited to or dependent on either. Accordingly, digital components and signals can replace signals and components described as analog herein, and vice versa.

Figure 1:
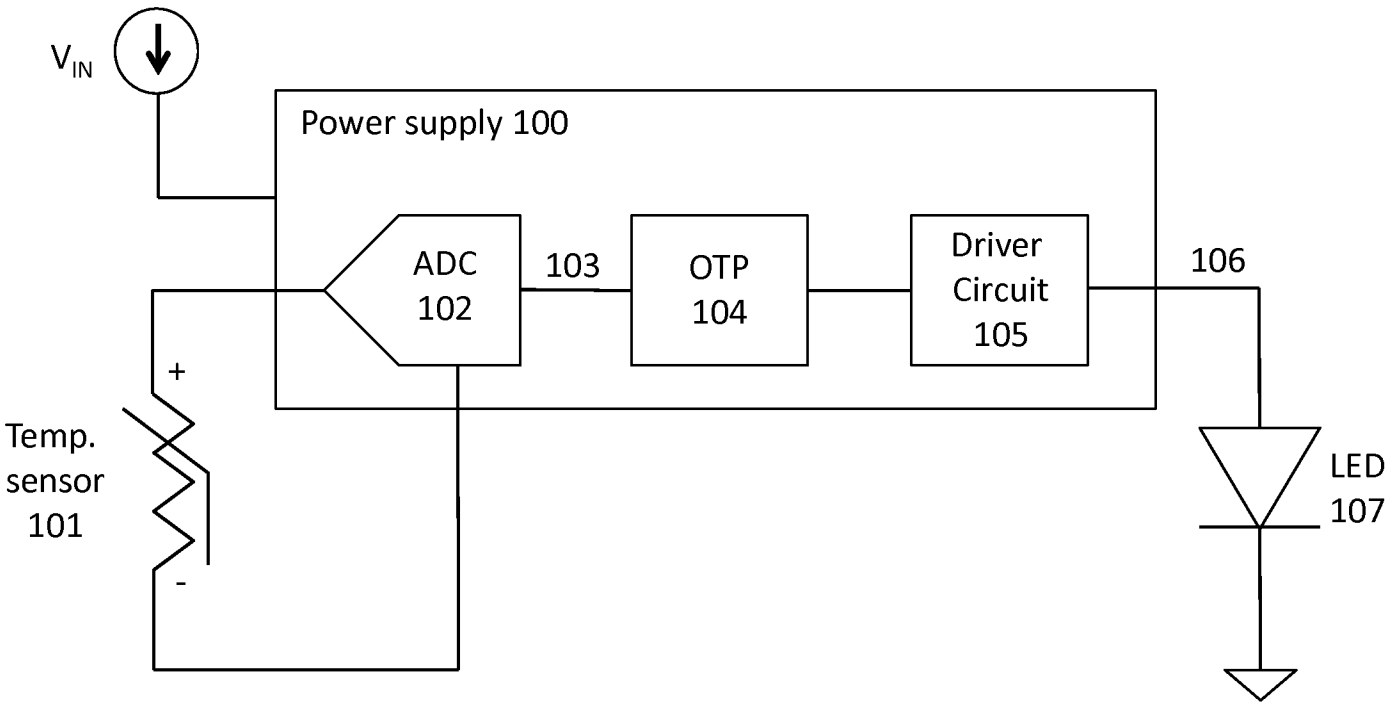
FIG. 1 is a block diagram illustrating a switching power supply implementing thermal de-rating, according to one embodiment.

FIG. 1 is a block diagram illustrating a switching power supply implementing thermal de-rating, according to one embodiment. The power supply 100 of FIG. 1 is coupled to a temperature sensor 101 and an LED load 107. The power supply includes an analog to digital converter ("ADC") 102, an over-temperature protection ("OTP") circuit 104, and a driver circuit 105. The power supply receives an input voltage $V_{IN}$, such as a rectified AC voltage, and a temperature signal from the temperature sensor, and provides a current to the LED based on the input voltage and the temperature signal.

The temperature sensor 101 can be, for example, a negative temperature coefficient resistor ("NTC") configured to produce a temperature signal representative of a temperature, such as the temperature of the LED 107. The temperature signal of the embodiment of FIG. 1 includes a voltage drop across the temperature sensor representative of the temperature of the LED. Alternatively, the temperature sensor can be any other sensor configured to produce a signal representative of the temperature of the LED. In one embodiment, the temperature sensor is placed in proximity with the LED in order to detect the temperature of the LED.

The ADC 102 receives the input voltage $V_{IN}$ and the temperature signal from the temperature sensor 101. The ADC produces a digital temperature signal representative of the temperature signal from temperature sensor 101. The ADC can be of any resolution, though the remainder of the description herein will describe embodiments of the power supply implementing 2-bit ADCs.

The OTP circuit 104 receives the digital temperature signal from the ADC 102 and determines an output current 106 to provide to the LED 107 via the driver circuit 105 based in part on the received digital temperature signal. The OTP circuit can be configured to determine or select an output current based on one or more pre-determined current settings associating an output current with a received digital temperature signal value. In one embodiment, the OTP circuit selects higher output currents for lower digital temperature signals and vice versa. It should be noted that in addition to determining an output current based on the received digital temperature signal, the OTP circuit can also select an output current based on a requested light output level, for instance from a user. In such embodiments, if a user requests a higher amount of light emission, the OTP circuit can determine a higher output current, and vice versa.

The driver circuit 105 can include a switch coupled to an input power supply and a switch controller configured to drive the switch such that the determined output current 106 is provided from the input power supply to the LED 107. The LED receives the output current from the driver circuit and emits light based on the output current.

A change in temperature at the LED 107 can result in a different temperature signal produced by the temperature sensor 101, an associated different digital temperature signal produced by the ADC 102, and an associated different output current 106. Thus, an increase in temperature at the LED can result in a decrease in output current to the LED and an associated decrease in emitted light by the LED. In the embodiment of FIG. 1, the OTP circuit 104 changes output currents as a step function in response to changing digital temperature signals. A low-resolution ADC will result in larger output current step changes throughout the de-rating envelope (and associated larger perceptible changes in light emission) than a high-resolution ADC. Thus, a high-resolution ADC can result in smaller perceptible changes in light emission by the LED, though high-resolution ADCs are generally more expensive than low-resolution ADCs.

Figure 2:
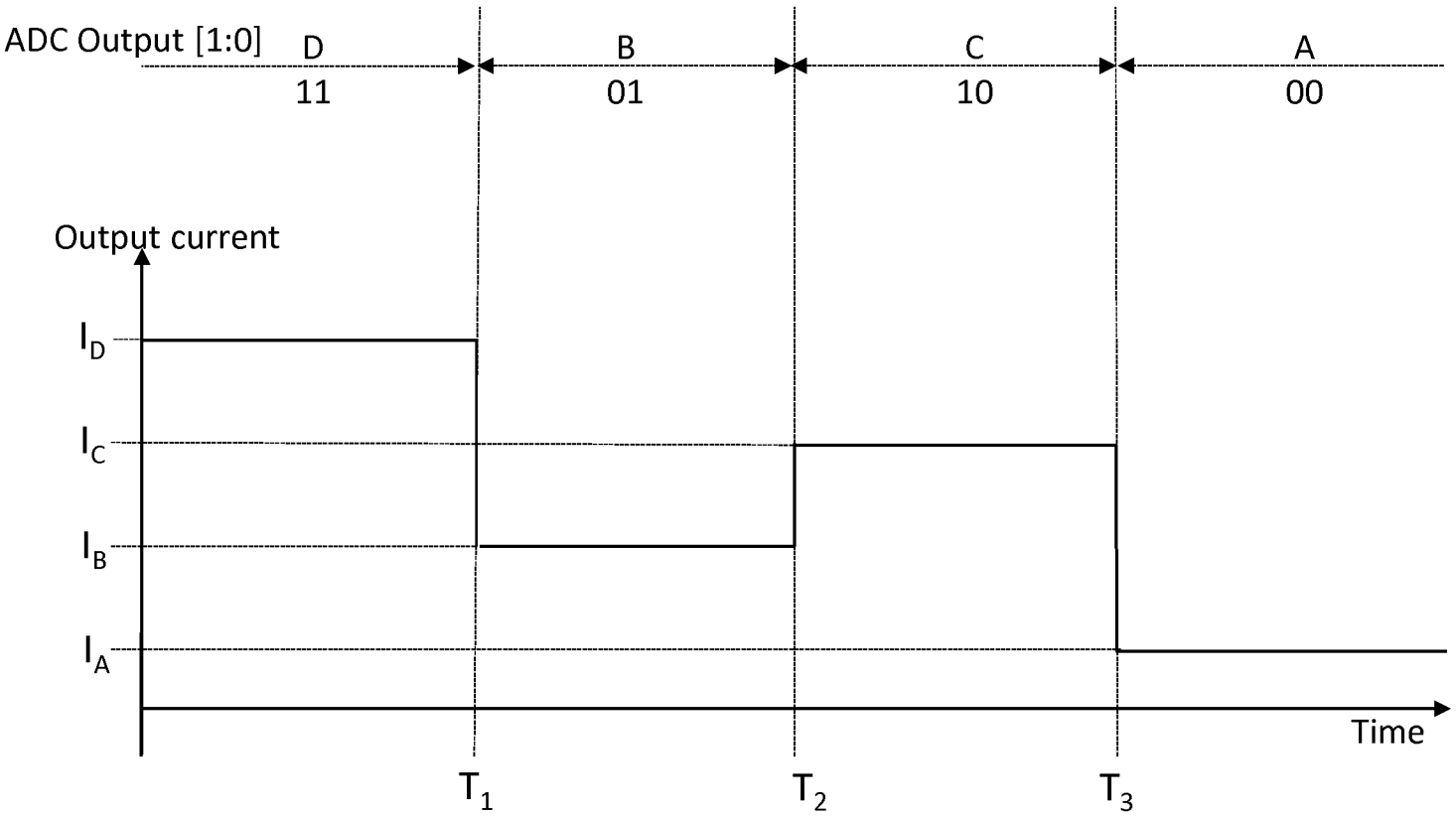
FIG. 2 illustrates, in the time domain, an example of temperature de-rating in the switching power supply of FIG. 1, according to one embodiment.

FIG. 2 illustrates, in the time domain, an example of temperature de-rating in the switching power supply of FIG. 1, according to one embodiment. Prior to time $T_1$, the temperature at the LED 107 detected by the temperature sensor 101 results in the production of a digital temperature signal "11" by the ADC 102. In response, the OTP circuit 104 produces an output current 106 of $I_D$.

At time $T_1$, a temperature increase at the LED 107 is reflected in the change in digital temperature signal 103 from "11" to "01". In response, the OTP circuit 104 steps the output current 106 down from $I_D$ to $I_B$. At time $T_2$, a temperature decrease at the LED is reflected in the change in digital temperature signal from "01" to "10". In response, the OTP circuit steps the output current up from $I_B$ to $I_C$. At time $T_3$, a temperature increase at the LED is reflected in the change in digital temperature signal from "10" to "00". In response, the OTP circuit steps the output current down from $I_C$ to $I_A$.

Each step adjustment to the output current 106 results in an immediate change in light intensity from the LED 107. In LED-based lighting applications, immediate changes in lighting intensity large enough to be noticed by a user are undesirable. Accordingly, while the use of a low-resolution ADC may reduce power supply system cost, such a power supply can result in flickering and other undesirable lighting artifacts.

Figure 3:
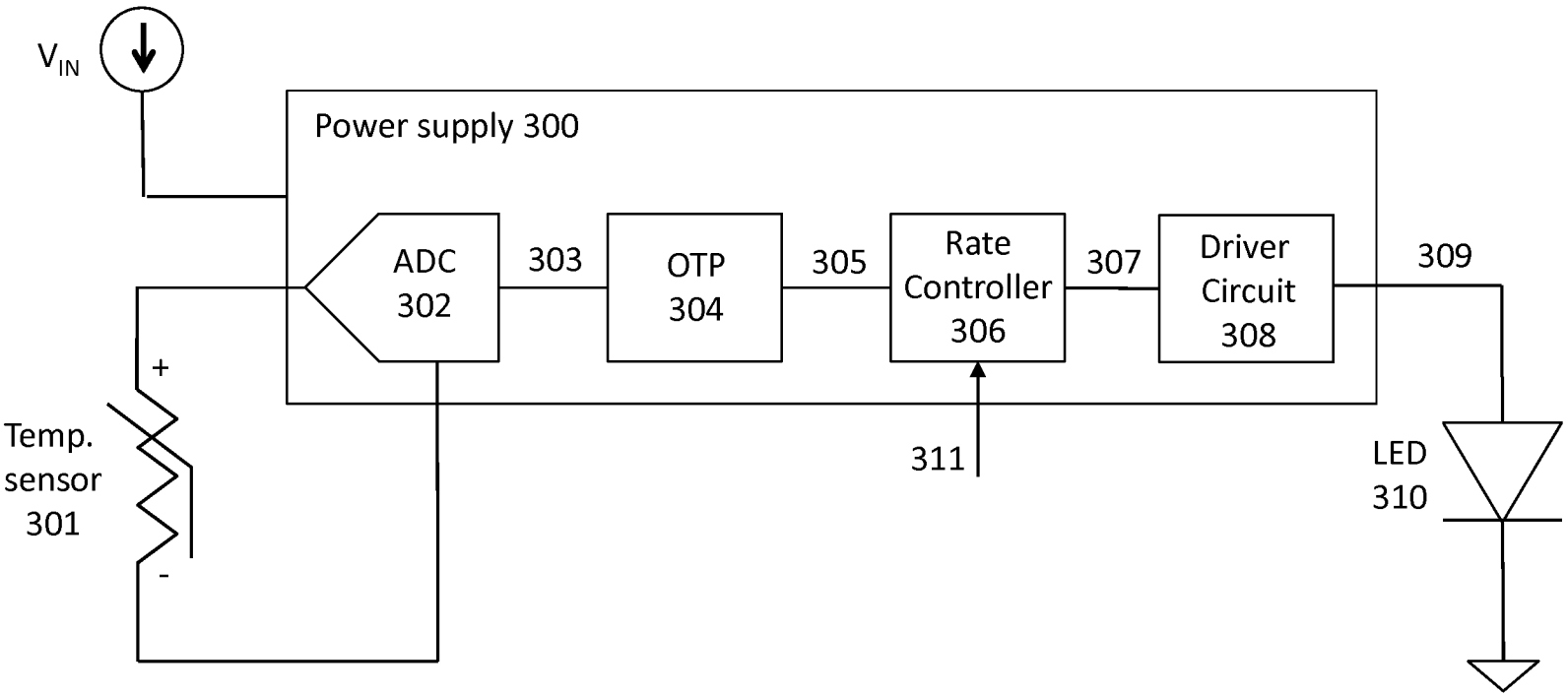
FIG. 3 is a block diagram illustrating a switching power supply implementing thermal de-rating with linear lighting output characteristics, according to one embodiment.

FIG. 3 is a block diagram illustrating a switching power supply implementing thermal de-rating with linear lighting output characteristics, according to one embodiment. The power supply 300 of FIG. 3 is coupled to a temperature sensor 301 and an LED load 310. The power supply includes an ADC 302, an OTP circuit 304, a rate controller 306, and a driver circuit 308. The power supply receives an input voltage $V_{IN}$, such as a rectified AC voltage, and a temperature signal from the temperature sensor, and provides a current to the LED based on the temperature signal.

In some embodiments, the temperature sensor 301, the ADC 302, the OTP circuit 304, the driver circuit 308, and the LED 310 are equivalent to the temperature sensor 101, the ADC 102, the OTP circuit 104, the driver circuit 105, and the LED 107, respectively. It should be noted that in other embodiments not described further herein, the embodiment of FIG. 3 can include different, fewer, or additional components than those described herein.

The temperature sensor 301 is configured to provide a temperature signal representative of the temperature of the LED 310 to the ADC 302. In response, the ADC provides a digital temperature signal 303 based on the temperature signal from the temperature sensor to the OTP circuit 304. The OTP circuit receives the digital temperature signal from the ADC and determines or selects a target output current 305 for the LED. The OTP circuit provides the target output current to the rate controller 306.

The rate controller 306 is configured to receive the target output current 305 from the OTP circuit 304, and determines or selects an output current rate of change 307 ("rate of change" hereinafter) from a present output current 309 to the target output current. The rate controller can provide the selected rate of change to the driver circuit 308. The rate of change can include a change in output current per interval of time, $\Delta I/\Delta t$. The driver circuit can receive the selected rate of change from the rate controller and the target current from the OTP circuit, and can adjust the present output current at the received rate of change until the present output current is equivalent to the target current.

In some embodiments, the rate controller 306 receives an output current feedback signal representative of the present output current 309, and selects a rate of change based on the target output current 305 and the present output current. In such embodiments, the rate controller can determine an output current based on the present output current, the target output current, and the selected rate of change. For example, if the present output current is 500 mA, if the target output current is 300 mA, and if the selected rate of change is 10 mA/second, the rate controller can instruct the driver circuit 308 to produce an output current starting at 500 mA and linearly decreasing by 5 mA each half second for 20 seconds, until the output current is 300 mA.

The rate of change 307 provided by the rate controller 306 can be a maximum rate of change, and the driver circuit 308 can increase or decrease the output current at a rate equal to or less than the maximum rate of change. Alternatively, the rate of change provided by the rate controller can be a minimum rate of change, and the driver circuit can increase or decrease the output current at a rate equal to or greater than the minimum rate of change. In some embodiments, the rate of change provided by the rate controller is a target rate of change, and the driver circuit can increase or decrease the output current at a rate of change within a pre-determined threshold of the target rate of change.

The rate of change 307 provided by the rate controller 306 can differ based on whether the target current 305 is greater or less than the present output current 309. For example, if the target current is greater than the present output current, the rate controller can provide a first rate of change for increasing the present output current. Continuing with this example, if the target current is less than the present output current, the rate controller can provide a second rate of change for decreasing the present output current. In this example, the first rate of change can be different than the second rate of change.

The rate of change 307 provided by the rate controller 306 can be based on a detected over-temperature condition. For example, if the OTP circuit 304 determines that the temperature of the LED 310 is too high, the rate controller 306 can provide a rate of change 307 based on how high the temperature of the LED is, how quickly the temperature of the LED needs to be reduced, how soon the LED will be damaged if operated at a present temperature of the LED, and the like.

In certain embodiments, the rate of change 307 provided by the rate controller 306 can be non-linear or non-constant. For example, the rate of change can be greater in the short-term when the driver circuit 308 begins to adjust the output current 309, and can be smaller as the output current approaches the target current 305.

The rate controller 306 can store pre-determined rates of change, for instance associating particular rates of changes with received target currents and/or with present output currents. Pre-determined rates of change can also associate particular rates of change with LED temperatures, LED light emission, or with any other operating parameter associated with the power supply 300. In some embodiments, the rate controller can receive a power supply user input 311 specifying a rate of change, a desired LED light emission, or the like. In such embodiments, the rate controller can provide a rate of change 307 to the driver circuit 308 based on the received user input.

Figure 4:
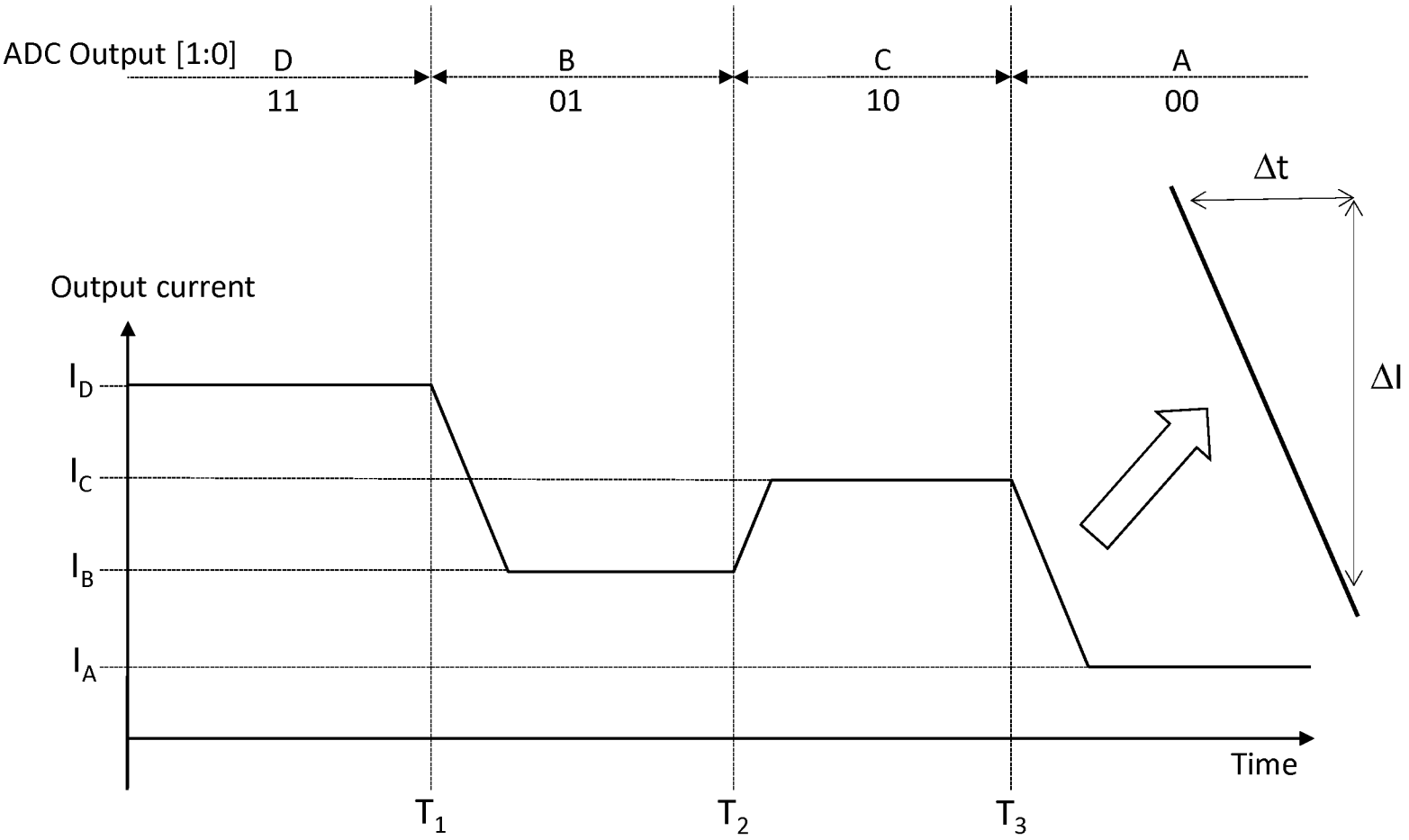
FIG. 4 illustrates, in the time domain, a first example of temperature de-rating with linear lighting output characteristics in the switching power supply of FIG. 3, according to one embodiment.

FIG. 4 illustrates, in the time domain, a first example of temperature de-rating with linear lighting output characteristics in the switching power supply of FIG. 3, according to one embodiment. Prior to time $T_1$, the output current 309 provided by the power supply 300 to the LED 310 is $I_D$. At time $T_1$, the temperature at the LED detected by the temperature sensor 301 results in the production of a digital temperature signal "01" by the ADC 302. In response, the OTP circuit 304 provides a target output current 305 of $I_B$. Similarly, at time $T_2$, the temperature at the LED detected by the temperature sensor results in the production of a digital temperature signal "10" by the ADC, and the OTP circuit provides a target output current of $I_C$. At time $T_3$, the temperature at the LED detected by the temperature sensor results in the production of a digital temperature signal "00" by the ADC, and the OTP circuit provides a target output current of $I_D$.

In response to receiving the target output currents $I_B$, $I_C$, and $I_A$ different from a present output current 309, the rate controller 306 determines an output current rate of change 307 to provide to the driver circuit 308. In the embodiment of FIG. 4, the determined rate of change is $\Delta I/\Delta t$ for each received target output current that is different from a present output current. Accordingly, at time $T_1$, the driver circuit receives the rate of change $\Delta I/\Delta t$ and decreases the output current from $I_D$ to $I_B$ at the rate $\Delta I/\Delta t$. Similarly, at time $T_2$, the driver circuit receives the rate of change $\Delta I/\Delta t$ and increases the output current from $I_B$ to $I_C$ at the rate $\Delta I/\Delta t$. Finally, at the $T_3$, the driver circuit receives the rate of change $\Delta I/\Delta t$ and decreases the output current from $I_C$ to $I_A$ at the rate $\Delta I/\Delta t$.

Figure 5:
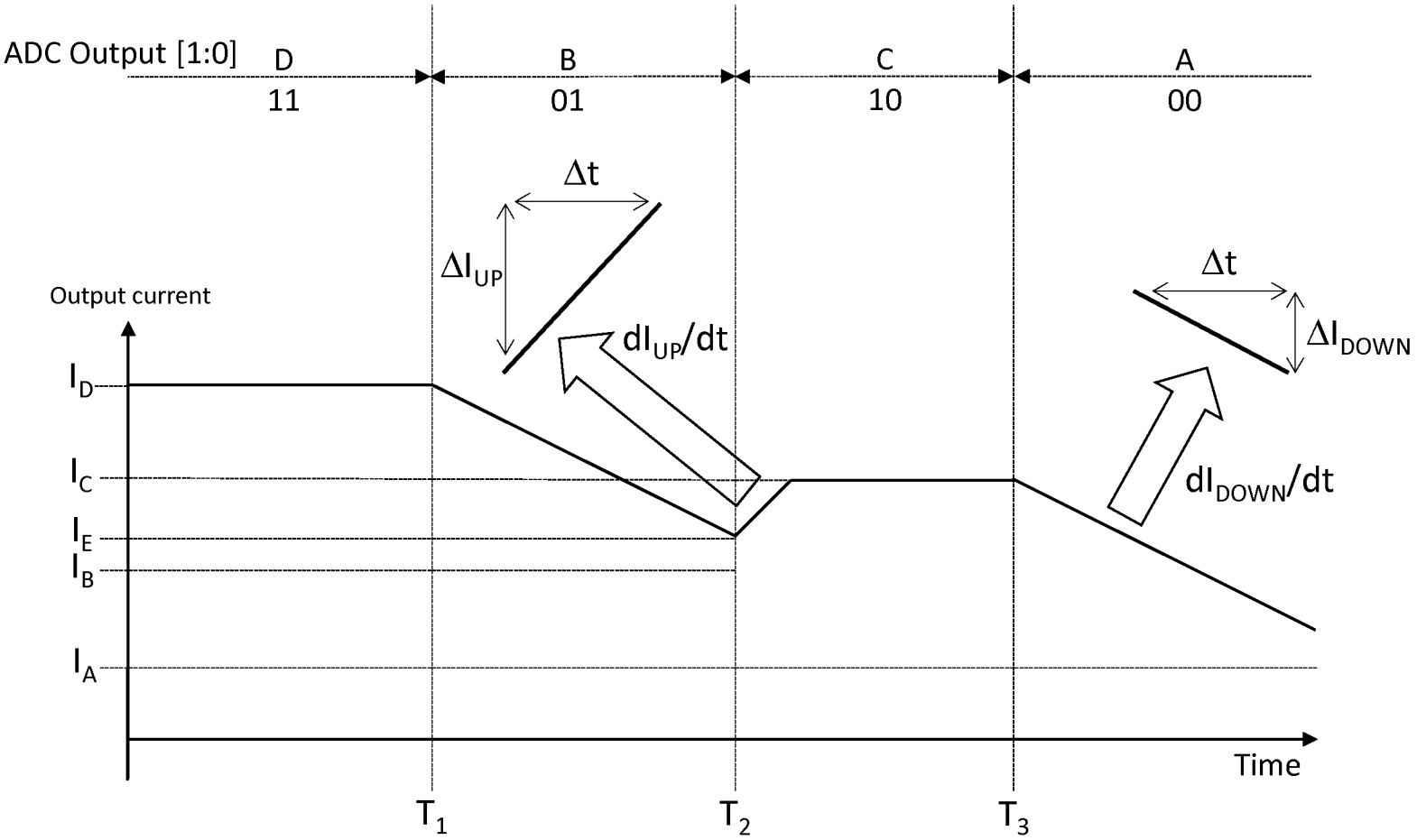
FIG. 5 illustrates, in the time domain, a second example of temperature de-rating with linear lighting output characteristics in the switching power supply of FIG. 3, according to one embodiment.

FIG. 5 illustrates, in the time domain, a second example of temperature de-rating with linear lighting output characteristics in the switching power supply of FIG. 3, according to one embodiment. In the embodiment of FIG. 5, the rate controller 306 determines a first rate of change 307 for a received target output current 305 that is lower than a present output current 309, and determines a second rate of change for a received target output current that is greater than a present output current.

At time $T_1$, the rate controller 306 receives a target output current 305 of $I_B$, determines that the target output current is lower than the present output current 309 of $I_D$, and provides a first rate of change of $dI_{DOWN}/dt$ to the driver circuit 308. In response, the driver circuit reduces the output current from $I_D$ at the rate of $dI_{DOWN}/dt$. At time $T_2$, the rate controller receives a target output current of $I_C$, determines that the target output current is greater than the present output current, and provides a second rate of change of $dI_{up}/dt$ (different from the first rate of change $dI_{DOWN}/dt$) to the driver circuit. Note that the rate of change $dI_{DOWN}/dt$ is such that at time $T_2$, the output current has been decreased to $I_E$, but has not been decreased all the way to the previous target output current of $I_B$. In response to receiving the rate of change $dI_{UP}/dt$, the driver circuit increases the output current from the present output current of $I_E$ at the time $T_2$ at the rate $dI_{UP}/dt$ until the present output current is equal to the target output current of $I_C$. At time $T_3$, the rate controller receives a target output current of $I_A$, determines that the target output current is less than the present output current, and provides the first rate of change $dI_{DOWN}/dt$ to the driver circuit. In response, the driver circuit reduces the output current from $I_C$ to $I_A$ at the rate of $dI_{DOWN}/dt$.

Figure 6:
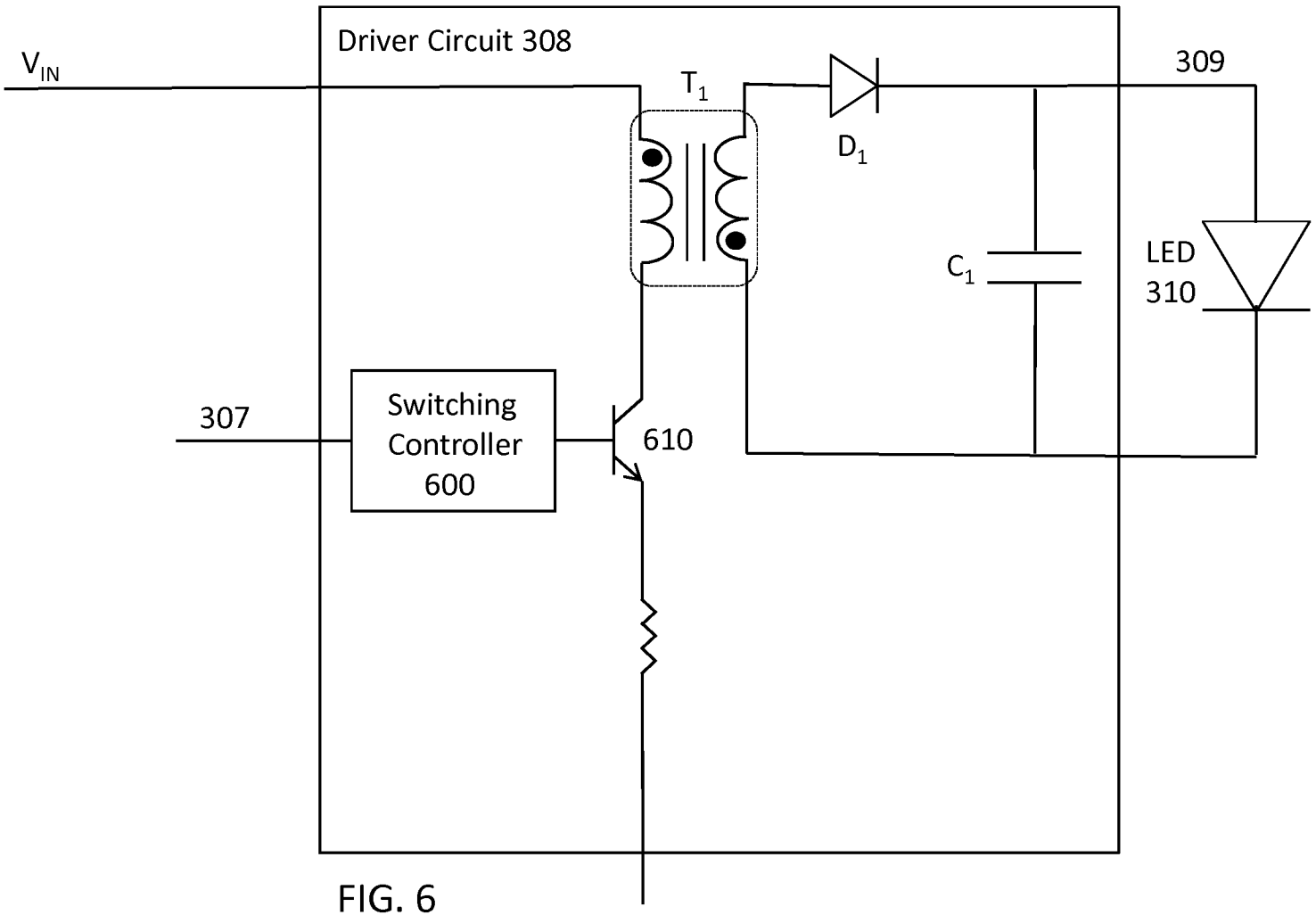
FIG. 6 is a block diagram illustrating an isolated switching power supply driver circuit coupled to an LED load, according to one embodiment.

FIG. 6 is a block diagram illustrating an isolated switching power supply driver circuit 308 coupled to an LED 310, according to one embodiment. In one embodiment, the driver circuit of FIG. 6 is the driver circuit 308 of FIG. 3. The driver circuit includes a switching controller 600, a switch 610, a transformer $T_1$, a diode $D_1$, and a capacitor $C_1$. The driver circuit receives an input voltage $V_{IN}$ and an output current rate of change 307, and produces an output current 309 for the LED.

The switching controller 600 controls the on state and the off state of the switch 610 based on (at least) the rate of change 307 and using, for example, pulse width modulation or pulse frequency module as described above. When the switch is on, energy is stored in a primary winding of the transformer $T_1$, which results in a negative voltage across a secondary winding of the transformer, reverse-biasing the diode $D_1$. Accordingly, the capacitor $C_1$ provides an output current 309 to the LED 310. When the switch is off, the energy stored in the primary winding of the transformer $T_1$ is transferred to the secondary winding of $T_1$, forward-biasing the diode $D_1$. With the diode $D_1$ forward-biased, the secondary winding of the transformer $T_1$ can provide the output current to the LED, and can transfer energy to the capacitor $C_1$ for storage.

Figure 7:
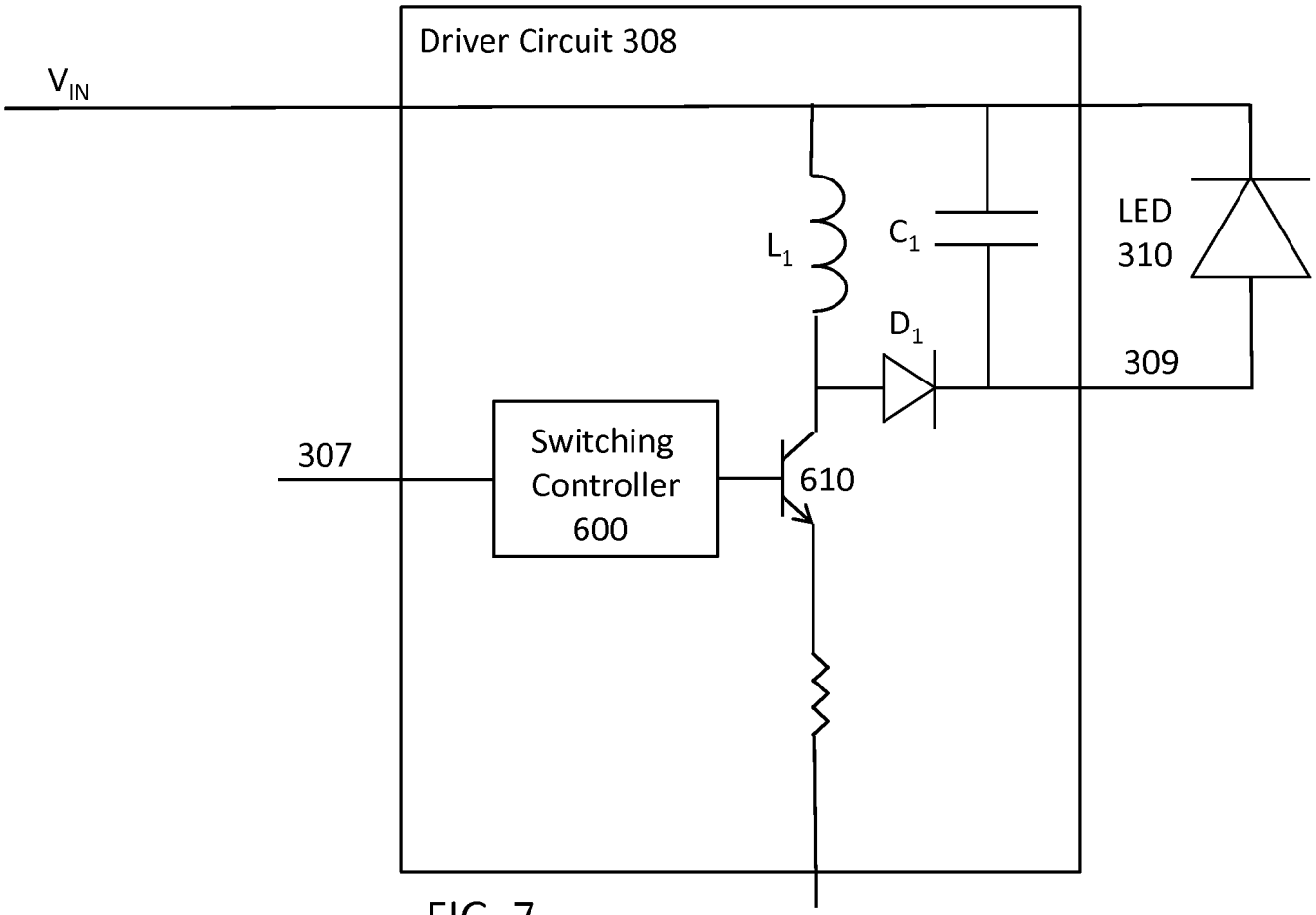
FIG. 7 is a block diagram illustrating a non-isolated switching power supply driver circuit coupled to an LED load, according to one embodiment.

FIG. 7 is a block diagram illustrating a non-isolated switching power supply driver circuit 308 coupled to an LED 310, according to one embodiment. In one embodiment, the driver circuit of FIG. 7 is the driver circuit 308 of FIG. 3. Like the driver circuit of the embodiment of FIG. 6, the driver circuit of FIG. 7 includes a switching controller 600 and a switch 610, receives an input voltage $V_{IN}$ and an output current rate of change 307, and produces an output current 309 for the LED.

The driver circuit 308 of FIG. 7 also includes an inductor $L_1$ coupled to the switch 610, a capacitor $C_1$, and a diode $D_1$. The switching controller 600 turns the switch on and off based on at least the received rate of change 307. When the switch is on, energy is stored in the inductor $L_1$, and the diode $D_1$ is reversed-biased. During this time, an output current 309 is provided by the capacitor $C_1$ to the LED 310. When the switch is off, the diode $D_1$ becomes forward-biased, and energy stored in the inductor $L_1$ is transferred to the LED as the output current and to the capacitor $C_1$ for storage.

Upon reading this disclosure, those of skill in the art will appreciate still additional alternative designs for a two-inductor based AC-DC offline power controller. Thus, while particular embodiments and applications have been illustrated and described, it is to be understood that the embodiments discussed herein are not limited to the precise construction and components disclosed herein and that various modifications, changes and variations which will be apparent to those skilled in the art may be made in the arrangement, operation and details of the method and apparatus disclosed herein without departing from the spirit and scope of the disclosure.

What is claimed is:

1. A power supply comprising:

an analog-to-digital converter ("ADC") configured to:

receive a temperature signal representing a temperature of a light-emitting diode ("LED"); and generate a digital temperature signal based on the received temperature signal;

an over-temperature protection ("OTP") circuit configured to:

receive the digital temperature signal;

detect an LED over-temperature condition based on the received digital temperature signal; and select a target output current for the LED based on the detected LED over-temperature condition; and a driver circuit configured to:

provide an output current to the LED;

receive an output current rate of change selected based on the provided output current and the target output current; and adjust the provided output current based on the received output current rate of change until the outputted current is substantially equal to the target output current.

2. The power supply of claim 1, wherein the temperature signal is received from a negative temperature coefficient resistor.

3. The power supply of claim 1, wherein the ADC comprises a 2-bit ADC.

4. The power supply of claim 1, wherein the LED over-temperature condition comprises the operation of the LED at a temperature over a pre-determined safe operation threshold.

5. The power supply of claim 1, wherein the target output current is less than a present output current.

6. The power supply of claim 1, wherein the output current rate of change comprises a maximum output current rate of change, and wherein adjusting the provided output current based on the received output current rate of change comprises adjusting the provided output current at a rate equal to or less than the output current rate of change.

7. The power supply of claim 1, wherein the output current rate of change comprises a minimum output current rate of change, and wherein adjusting the provided output current based on the received output current rate of change comprises adjusting the provided output current at a rate equal to or greater than the output current rate of change.

8. The power supply of claim 1, wherein the output current rate of change is selected such that the over-temperature condition is remedied within a pre-determined interval of time upon adjusting the provided output current at the output current rate of change.

9. The power supply of claim 1, wherein the output current rate of change is selected such that lighting artifacts are minimized when adjusting the provided output current at the output current rate of change.

10. The power supply of claim 1, wherein the output current rate of change is selected based on one or more pre-determined rates of change associated with provided output currents and target output currents, and wherein the selected out current rate of change comprises the pre-determined rate of change most closely associated with provided output current and the target output current.

11. A power supply comprising:

an analog-to-digital converter ("ADC") configured to generate a digital temperature signal representative of a temperature of a light-emitting diode ("LED");

an over-temperature protection ("OTP") circuit configured to produce a target output current based on the digital temperature signal; and a driver circuit configured to produce an output current for the LED, and to adjust the output current based on an output current rate of change selected on the produced output current and the target output current.

12. The power supply of claim 11, wherein the output current rate of change comprises a maximum output current rate of change, and wherein adjusting the output current based on the output current rate of change comprises adjusting the produced output current at a rate equal to or less than the output current rate of change.

13. The power supply of claim 11, wherein the output current rate of change comprises a minimum output current rate of change, and wherein adjusting the output current based on the output current rate of change comprises adjusting the produced output current at a rate equal to or greater than the output current rate of change.

14. The power supply of claim 11, wherein a first output current rate of change is selected if the target output current is greater than a present output current, and wherein a second output current rate of change is selected if the target output current is less than a present output current.

15. The power supply of claim 14, wherein the first output current rate of change is different than the second output current rate of change.

16. A method of providing power to a light-emitting diode ("LED") comprising:

providing an output current to the LED;

detecting an over-temperature condition at the LED based on a temperature of the LED;

determining a target output current for the LED based on the detected over-temperature condition;

selecting an output current rate of change based on the determined target output current and based on the provided output current; and adjusting a provided output current to the LED based on the selected output current rate of change until the provided output current is substantially equal to the target output current.

17. The method of claim 16, wherein detecting an over-temperature condition at the LED comprises detecting a temperature of the LED over a pre-determined safe operation threshold of the LED.

18. The method of claim 16, wherein determining a target output current for the LED comprises determining a target output current that is less than the provided output current to the LED.

19. The method of claim 16, wherein the output current rate of change is selected such that the over-temperature condition is remedied within a pre-determined interval of time upon adjusting the provided output current to the LED based on the output current rate of change.

20. The method of claim 16, wherein the output current rate of change is selected such that lighting artifacts are minimized upon adjusting the provided output current to the LED based on the output current rate of change.

21. A method of providing power to a light-emitting diode ("LED"), comprising:

providing a first output current to the LED;

selecting a second output current for the LED based on a detected temperature of the LED;

selecting an output current rate of change based on the first and second output currents; and adjusting the provided first output current to the LED at the selected output current rate of change until the provided first output current is equal to the second output current.

* * * * *